US005378340A

United States Patent [19]

Van de Wynckel et al.

[11] Patent Number: 5,378,340

[45] Date of Patent: Jan. 3, 1995

[54] APPARATUS FOR THE ELECTROLYTIC RECOVERY OF SILVER

[75] Inventors: Werner Van de Wynckel, Mortsel; Dirk de Ruijter, Deurne; Benny Jansen, Geel; Frank Michiels, Arendonk, all of Belgium

[73] Assignee: AGVA-Gevaert N. V., Mortsel, Belgium

[21] Appl. No.: 194,014

[22] Filed: Feb. 9, 1994

[30] Foreign Application Priority Data

Feb. 16, 1993 [EP] European Pat. Off. ..... 93200427.8

[51] Int. Cl.[6] ..... C25C 7/00

[52] U.S. Cl. ..... 204/272

[58] Field of Search ..... 204/231, 272, 267

[56] References Cited

U.S. PATENT DOCUMENTS

| | | | |
|---|---|---|---|
| 3,985,634 | 10/1976 | Larson et al. | 204/272 X |
| 4,028,212 | 6/1977 | Bowen et al. | 204/272 |
| 4,439,300 | 3/1984 | Houseman | 204/272 |
| 4,440,616 | 4/1984 | Houseman | 204/272 |
| 4,840,717 | 6/1989 | Dzodin | 204/272 X |
| 5,203,979 | 4/1993 | Üffinger et al. | 204/272 |

*Primary Examiner*—Donald R. Valentine
*Attorney, Agent, or Firm*—William J. Daniel

[57] ABSTRACT

Silver is recovered from solutions containing the same, e.g. photographic processing solutions, in an electrolytic cell including an anode, a removable cathode and electrical connectors therefore on the exterior of the cell. The removable cathode is circular in configuration and encircles the anode. On the interior of the cell, electrical contact is made around the upper end of the cathode by means of an annular contact surface providing a large area of contact and minimizing the risk of occurrence of a corrosive connection. The upper end of the cathode is shaped for deformation, preferably in the form of castellations, and is clampingly pressed against the contact surface by a frusto-conical extension of the lid of the cell. The lid fits in threadwise engagement within the opening to the cell through which the cathode can be removed. As the lid is threaded into the cell opening, the frusto-conical extension thereof bears against the deformable cathode end portion and clamps the same against the contact surface. In this arrangement, the contact surface is situated above the level of the electrolyte in the cell so as to be protected against corrosion by the electrolyte.

7 Claims, 3 Drawing Sheets

APPARATUS FOR THE ELECTROLYTIC RECOVERY OF SILVER

FIELD OF THE INVENTION

The present invention relates to an apparatus for the electrolytic recovery of silver from solutions containing silver, in particular used photographic solutions such as fixing and bleach-fixing solutions.

BACKGROUND OF THE INVENTION

Electrolytic silver recovery from used photographic solutions is a common way to extend the life of such solutions. An apparatus is known from German patent specification DE 4007906-C1 (Kodak AG) for the electrolytic recovery of silver from solutions containing silver, the apparatus comprising an electrolytic cell, an anode and a removable cathode positioned within the cell and encircling the anode and electrical connectors outside the cell for the cathode and the anode. In this apparatus the cell includes an electrically conductive contact surface which defines an aperture in the side of the cell. The cathode is in the form of a graphite foil carried on a backing of polymeric material. Clamping means in the form of a bolt pass through the aperture and through a hole in the cathode to clamp the cathode against the contact surface to complete an electrical connection from the cathode to the cathode connector.

In an electrolytic cell, the cathode electrical connection is of vital importance since the electrode is the basis for the cathodic reactions which are most important in a de-silvering apparatus. The electrical connection should make sure that enough current can flow to the cathode, without causing a significant ohmic voltage drop between the cathode connector and the cathode itself. The reason for this is that the controlling of the current is usually done by means of the potential on this cathode as one pole and a reference electrode or the anode as the other pole. The potential on the cathode is in the range of some hundred millivolts and should be measured with fair accuracy.

For example, where an Ag/AgCl reference electrode is used, the potential between the cathode and the reference electrode is about 400 mV. When the unit is to perform optimally, meaning employing the maximum current without causing side reactions to occur, the potential should be measured with an accuracy of some millivolts. As a result any ohmic resistance between the cathode and the electrical current supply will cause a measurement fault. While the arrangement disclosed in DE 4007906 may provide a secure electrical connection between the cathode and its exterior connector, the contact surface is small and in use lies below the level of the electrolyte in the cell. This may lead to leakage if the bolt is not tightened sufficiently or to damage to the cathode if it is over-tightened. In any case, contact between the contact surface and the electrolyte may result in corrosion of the contact surface and ultimate build-up of the electrical resistance there across.

A further electrolytic recovery apparatus with removable cathode is disclosed in U.S. Pat. No. 3,985,634. In this apparatus the electrical contact with the cathode is established through a conductor which enters with a lip in sliding contact with the upper edge of a cylindrical cathode as the lid of the apparatus is clamped on the housing. Reliable electrical contact is obtained by a tab and corresponding screw that apply extra pressure to the point where the lip and cathode edge contact. This construction has the same disadvantage as the apparatus described hereinbefore, namely an electrical contact with limited contact surface. Also the protruding tab of the lid is vulnerable and the presence of an electrical connection on the lid makes its manipulation less convenient .

Still another recovery apparatus is disclosed in CH-A-647,005. Electrical contact with a cylindrical removable cathode occurs through elastic fingers protruding from the lid of the apparatus. The contact surface is limited and deformation of the contact fingers by careless manipulation of the lid may impede the successful use on the long run.

It is an object of the present invention to provide an electrolytic cell in which a secure electrical connection can be assured between the cathode and its exterior connector over a large surface and without the risk of leakage or the build-up of resistive corrosion.

SUMMARY OF THE INVENTION

In accordance with the present invention, an apparatus for the electrolytic recovery of silver from solutions containing silver, the apparatus comprising an electrolytic cell, an anode and a removable cathode positioned within the cell and encircling the anode and electrical connectors outside the cell for the cathode and the anode, the cell including an electrically conductive contact surface, clamping means being provided to clamp a deformable portion of the cathode against the contact surface to complete an electrical connection from the cathode connector to the cathode, is characterised thereby that the electrically conductive contact surface is positioned to define an upper circular opening of the electrolytic cell through which the cathode may be removed, and that the clamping means comprises a removable lid for closing said circular upper opening of the electrolytic cell, the lid having a frusto-conical lower end engaging the upper edge of the cathode for clamping it against the electrically conductive contact surface.

The provision of the contact surface in an upper part of the electrolytic cell, in particular an annular contact surface, enables this surface to be above the level of the electrolyte in the cell in use, thus reducing the risk of leakage and corrosion. The upper opening has a dimension which is sufficient to enable the removal of the cathode from the cell. By providing the contact surface around this opening, a large contact surface can be assured, reducing the risks of a resistive connection occurring.

The clamping means for clamping the deformable portion of the cathode to the contact surface may comprise a removable lid for closing the circular upper opening of the electrolytic cell. Thus, as the lid is put securely in place after the insertion of the cathode into the cell, the deformable portion of the cathode is forced against the contact surface. This may be achieved in particular by the lid being provided with a clamping surface, corresponding in shape to the contact surface, so as to clamp the deformable portion of the cathode there-between.

To firmly secure the lid in the opening of the cell, the lid and the electrolytic cell may be provided with cooperating screw-threaded portions. In this manner, as the lid is screwed into the upper opening, the deformable portion of the cathode is deformed to the extent necessary to press it firmly against the contact surface where it is held securely by pressure from the clamping surface of the lid. A seal may be provided between the lid and the electrolytic cell in the vicinity of the opening to prevent leakage of the electrolyte from the cell, and thereby to maintain an air space above the surface of the electrolyte, the contact surface being located in this air space.

The cathode is preferably in sheet form and ideally has a frusto-conical cross-section, with its larger radius end uppermost, that is towards the circular upper opening of the electrolyte cell. This configuration enables easy removal of the cathode even after a silver deposit has built up there-on after use. The upper, larger radius of the frusto-conical cathode preferably corresponds closely to the inner radius of the contact surface. Usable cathode materials include stainless steel, silver and silver alloys, the non-silver containing materials being preferred from the point of view of costs, while the silver containing materials cause fewer starting-up problems.

The deformable portion of the cathode may be elastically or non-elastically deformable. We prefer that the cathode is in sheet form and the deformable portion is comprised by-a castellated upper edge of the cathode. This may be achieved by providing a number of longitudinal incisions extending from the upper edge of the cathode, defining between them a number of tabs which can be bent outwardly by the clamping means to lie against the contact surface.

The electrolytic cell is suitably formed of electrically non-conductive material and may be generally cylindrical, although other shapes are possible. A cylindrical shape to the cell enables the cathode to be positioned near to the wall of the cell. The cell will be provided with inlet and outlet ports for the electrolyte liquid.

Usually the electrolytic cell further comprises a reference electrode. This may conveniently be positioned adjacent the outlet port of the cell. The reference electrode may be a calomel type electrode or an Ag/AgCl type electrode. A suitable electrode has been disclosed in our co-pending application EP 92203439.2 filed Nov. 11, 1992 and entitled "pH Sensitive Reference Electrode in Electrolytic Desilvering".

The contact surface is formed by a steel ring connected to the cathode connector. This connection should be a permanent connection. Usually the anode will be permanently connected to the exterior anode connector.

The material used for the anode is less critical, although platinated titanium is usually used. The anode may be in the form of a rod, located at the axis of the electrolytic cell, where this is in cylindrical form. In any case, the anode is encircled by the cathode.

PREFERRED EMBODIMENTS OF THE INVENTION

The invention will now be further described, purely by way of example, by reference to the accompanying drawings in which.

Figure 3A:
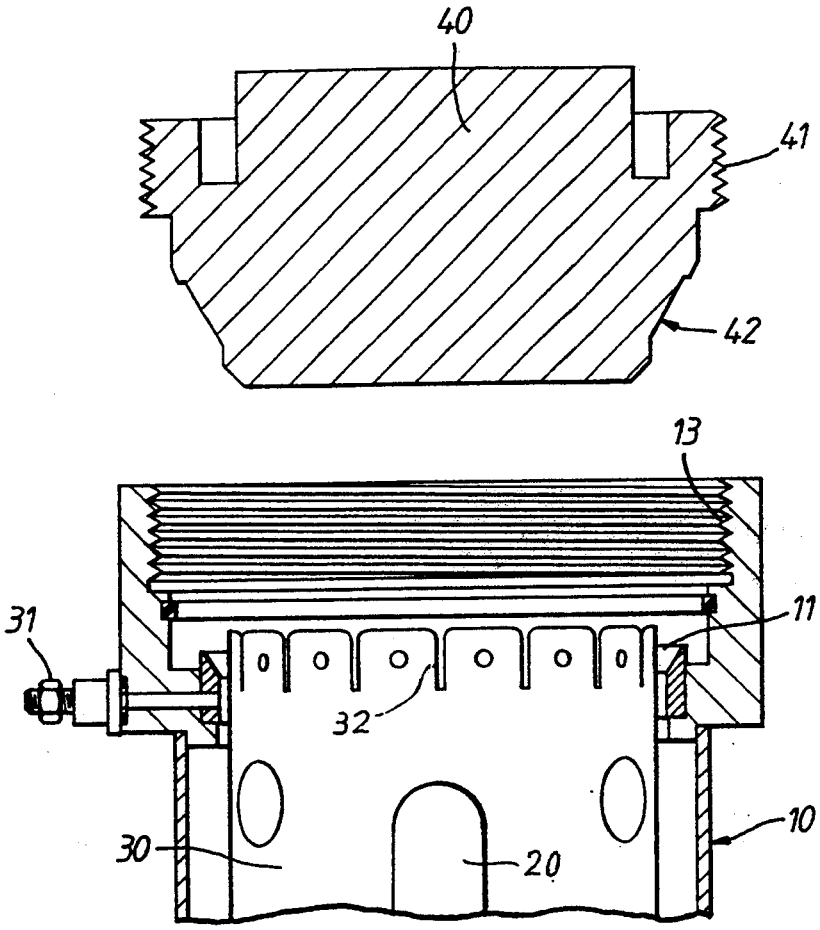
FIG. 3A is an exploded view of the upper portion of the apparatus shown in FIG. 1.
Figure 3B:
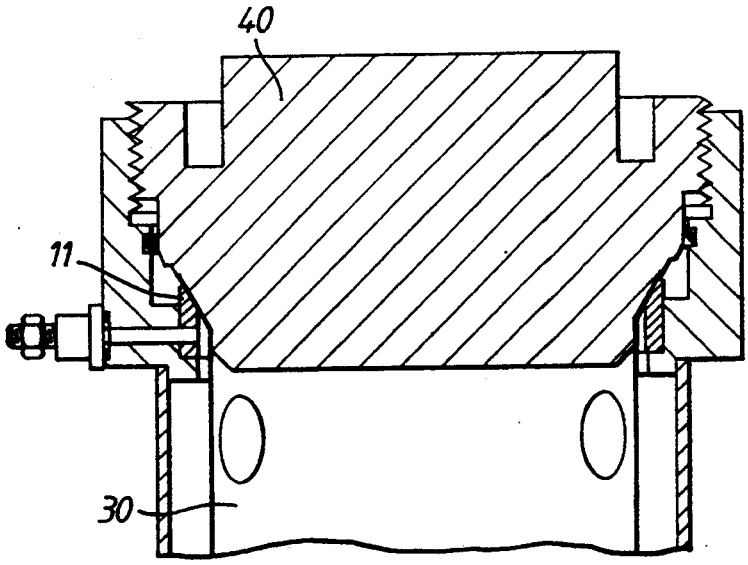

FIG. 3B corresponds to FIG. 3A, in the assembled position; and

Figure 1:
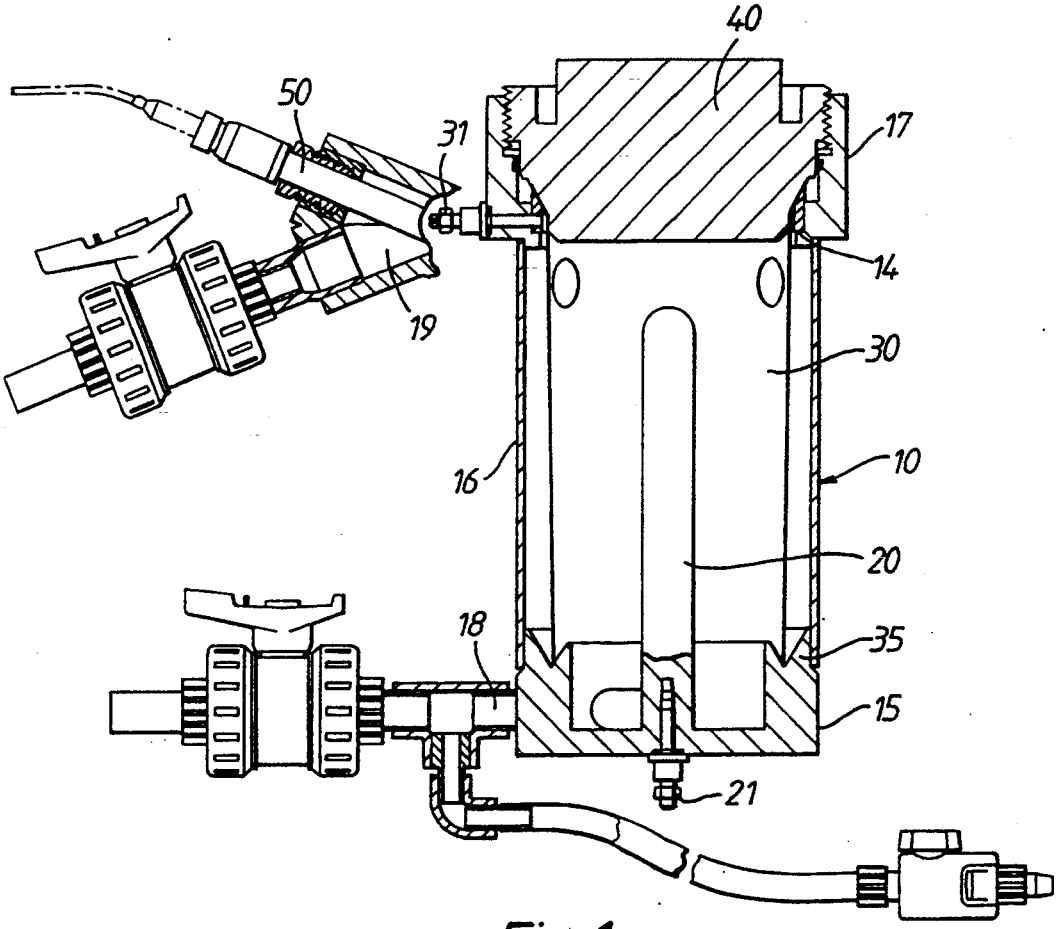
FIG. 1 shows, partly in cross-section, an apparatus according to the invention.
Figure 2:
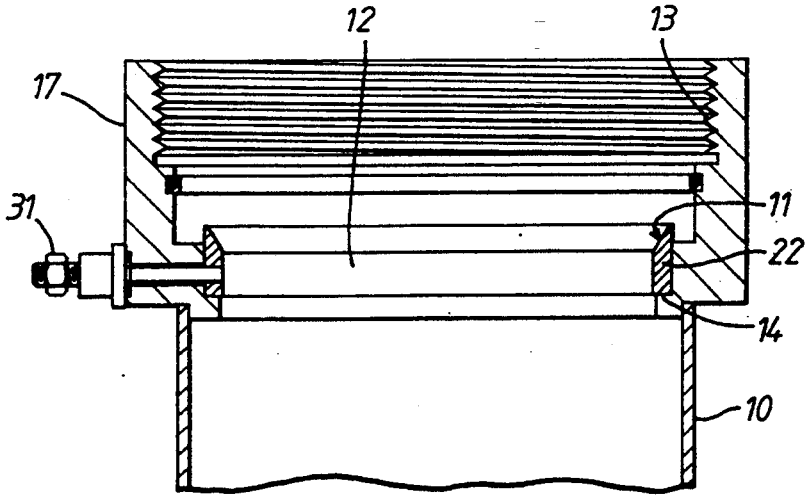
FIG. 2 shows, in cross section, the upper part of the electrolytic cell of the apparatus shown in FIG. 1.
Figure 4:
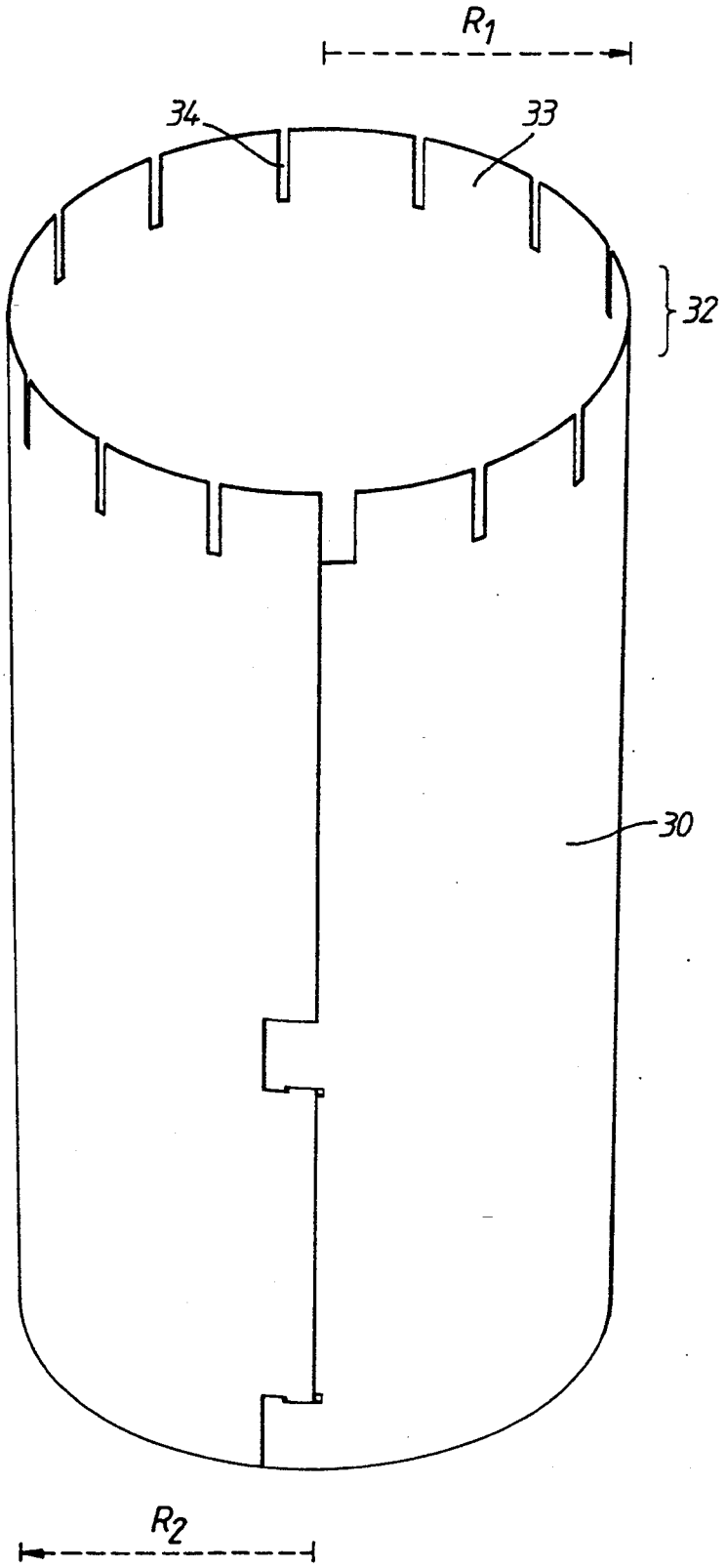

FIG. 4 is a perspective view of the cathode used in the apparatus shown in FIGS. 1 to 3.

As shown in FIG. 1, the apparatus comprises an electrolytic cell 10, formed of electrically non-conductive material such as PVC, and comprising a base 15, sides 16 and an upper portion 17. An electrolyte inlet port 18 is provided towards the bottom of the cell and an electrolyte outlet port 19 is provided towards the top of the cell.

An anode 20, in the form of a platinised titanium rod, is secured to the base of the cell by means of a bolt 21 which acts as an electrical connector for the anode. A reference electrode 50 protrudes into the outlet port 19 of the cell.

As is shown more clearly in FIG. 2, the upper part 17 of the cell is in the form of a neck portion having an opening 12 defined by a stainless steel ring 22 having an inwardly directed annular contact surface 11. The contact surface 11 is frusto-conically shaped, having its narrower radius downwards. The stainless steel ring 22 is permanently fixed to one end of a bolt 31 which extends through the wall of the cell and provides a connector for the cathode 30. Positioned in the neck of the cell, below the level of the annular ring 22, is a sealing ring 14.

As can seen in FIGS. 1, 3A and 3B, the apparatus further comprises a lid 40 so shaped as to fit into the neck portion of the cell. The lid 40 is formed of electrically non-conductive material such as PVC. The lower portion of the lid 40 has a frusto-conically shaped clamping surface 42, shaped to correspond to the shape of the annular contact surface 11. The upper part of the lid 40 has a thread 41 which engages with a thread 13 in the neck portion of the cell.

Referring in particular to FIG. 4, the cathode 30, formed for example of stainless steel sheet having a thickness of 100 μm, is wrapped around into a frusto-conical configuration. The upper radius $R_1$ is marginally larger than the lower radius $R_2$ by a factor of 1.05. Castellations 33 are formed at the upper edge of the cathode by the provision of incisions 34 extending longitudinally away from that edge. The castellations or tabs 33 together form a deformable upper edge portion 32 of the cathode, the sheet material of which the cathode is formed being sufficiently resilient to allow the castellations to bend outwardly in response to outwardly directed force.

The cathode 30 is located in the cell 10 with its bottom edge supported by a cathode support ledge 35 in the cell. In this position the deformable upper edge portion 32 of the cathode lies adjacent the stainless steel ring 22. As the lid is screwed into place, by engagement of the threads 13 and 41, the frusto-conical contact surface 42 on the lid bears against the castellations 33 of the cathode 30, causing these castellations to bend outwardly against the annular surface 11 of the ring 22. Tightening of the lid caused the castellations to be clamped firmly by the lid against the annular contact surface 11, thereby establishing good electrical contact there-between.

In the closed position of the lid, the sealing ring 14 bears against the outer surface of the lid 40, thereby forming a tight seal. Electrolyte liquid is now fed into the cell by way of the inlet port 18, fills the cell and exits by way of the outlet port 19. The effect of the sealing ring 14 is to prevent the electrolyte level rising above the level of the outlet port 19, so maintaining an air space above the liquid and preventing contact between the liquid and the annular contact surface 11. The risk of corrosion of the latter is thereby reduced.

The cell is then operated under usual conditions, during which a silver deposit builds up on the cathode 30, primarily on the inside surface thereof. After a period of time determined by the required amount of deposited silver, the operator unscrews the lid 40 and lifts the cathode 30 out of the cell. Due to the frusto-conical cross-section of the cathode, the sides of the cathode will not foul against the ring 22, even when some small amount of silver deposit has built up on the outside surface thereof. The silver deposit is then removed from the cathode, which may then be re-used as desired or replaced by another of similar construction for the desilvering of a further batch of electrolyte.

We claim:

1. An apparatus for the electrolytic recovery of silver from solutions containing silver, the apparatus comprising an electrolytic cell (10), an anode (20) and a removable cathode (30) positioned within the cell (10) and encircling the anode (20) and electrical connectors (21,31) outside the cell (10) for the cathode (30) and the anode (20), the cell (10) including an electrically conductive contact surface (11), clamping means being provided to clamp a deformable portion (32) of the cathode (30) against the contact surface (11) to complete an electrical connection from the cathode connector (31) to the cathode (30), characterised in that the electrically conductive contact surface (11) is positioned to define an upper circular opening (12) of the electrolytic cell (10) through which the cathode (30) may be removed, and that the clamping means comprises a removable lid (40) for closing said circular upper opening (12) of the electrolytic cell (10), the lid having a frustoconical lower end (42) engaging the upper edge of the cathode for clamping it against the electrically conductive contact surface.

2. An apparatus according to claim 1, characterised in that the upper opening (12) of the electrolytic cell has a conically widened inlet which co-operates with the conical end of the lid.

3. An apparatus according to claim 1, wherein the upper circular opening of the electrolytic cell is formed by an electrically conductive ring (22) having an inwardly directed annular contact surface (11).

4. An apparatus according to claim 2, wherein the lid (40) and the electrolytic cell (10) are provided with co-operating screw-threaded portions (41, 13).

5. An apparatus according to claim 1, wherein the cathode (30) has a frusto-conical cross-section, with its larger radius end uppermost, towards the circular opening (12) of the electrolytic cell (10).

6. An apparatus according to claim 1, wherein the electrolytic cell (10) is generally cylindrical.

7. An apparatus according to claim 1, wherein the electrolytic cell (10) further comprises a reference electrode (50).

* * * * *